United States Patent [19]

Jeffreys

[11] Patent Number: 4,848,192

[45] Date of Patent: Jul. 18, 1989

[54] MULTI-PURPOSE STRAP-TYPE WRENCH

[76] Inventor: Keith Jeffreys, 3013 Sandalwood Dr., Morrow Bay, Calif. 93442

[21] Appl. No.: 232,041

[22] Filed: Aug. 15, 1988

[51] Int. Cl.[4] ..... B25B 13/52

[52] U.S. Cl. ..... 81/64

[58] Field of Search ..... 81/64, 3.43; 294/31.2, 294/74, 149, 150

[56] References Cited

U.S. PATENT DOCUMENTS

| | | | |
|---|---|---|---|
| 285,048 | 9/1883 | Liljencrantz | 81/64 |
| 803,231 | 10/1905 | Huntley | 81/64 |
| 1,396,411 | 11/1921 | Dufford | 81/64 |

*Primary Examiner*—Debra Meislin

*Attorney, Agent, or Firm*—John J. Posta, Jr.

[57] ABSTRACT

A strap-type wrench for use in removing rotatable closures is disclosed which has two rings to assist in removing the slack in the gripping strap, and a pressure plate with a frictional gripping surface positioned on the wrench to allow the frictional gripping surface to be forced radially inwardly against the object being gripped by the wrench, thereby enhancing the frictional grip of the frictional gripping surface on the object. The rings may be sequentially pulled to first tighten the gripping strap by pulling the first ring and then to pull the slack portion of the gripping strap gathered by the first ring with the second ring in a path which will resist loosening due to frictional restraint of a portion of the gripping strap located between the wrench handle and itself. The pressure plate is rotatably mounted onto the wrench handle at the end opposite the frictional gripping surface, and in use is rotatable into a position in which the end of the wrench handle is bearing against the end of the pressure plate on which the frictional gripping surface is located with an essentially radially inwardly directed force toward the article being gripped.

22 Claims, 2 Drawing Sheets

FIG. 1
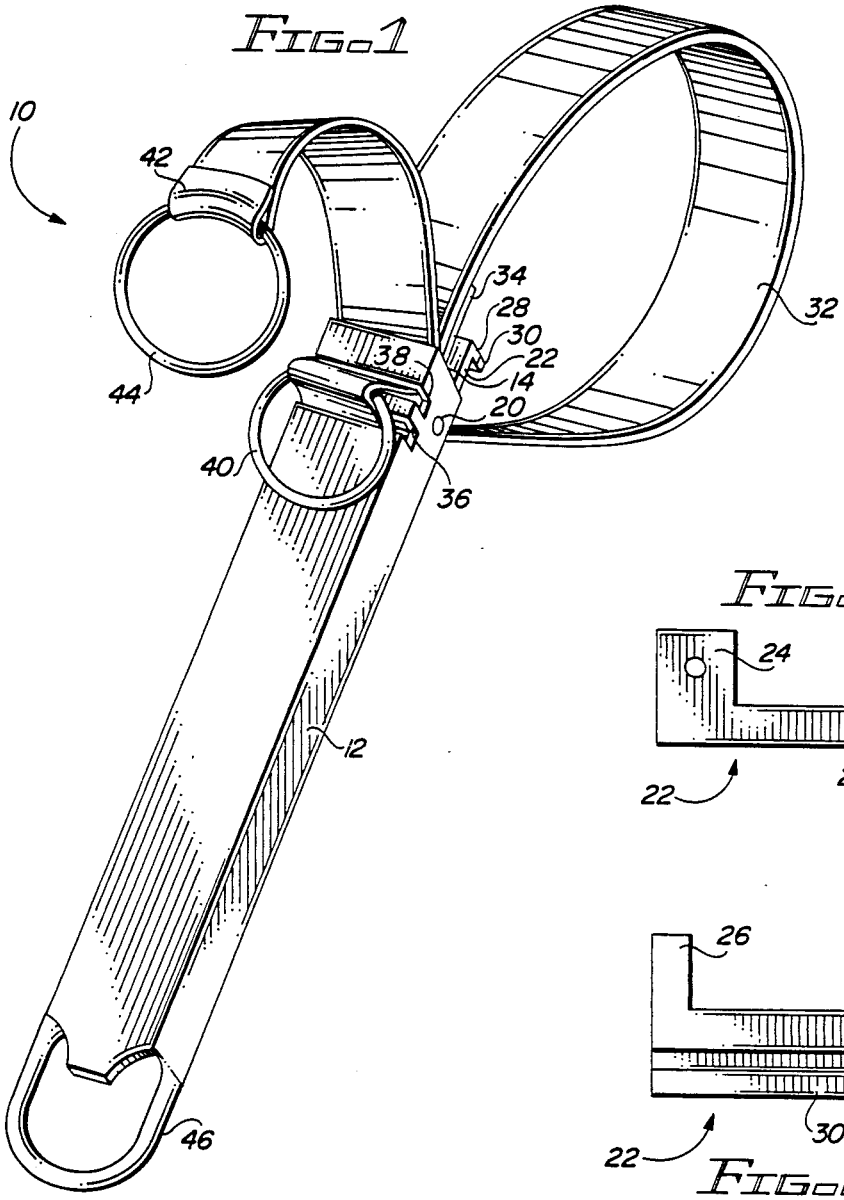
FIG. 2
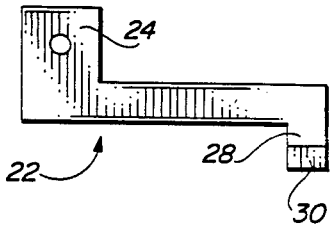
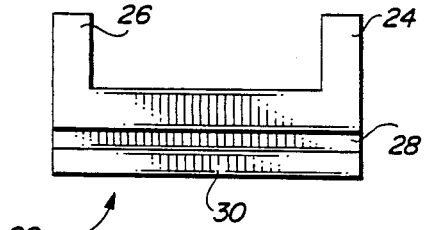
FIG. 3
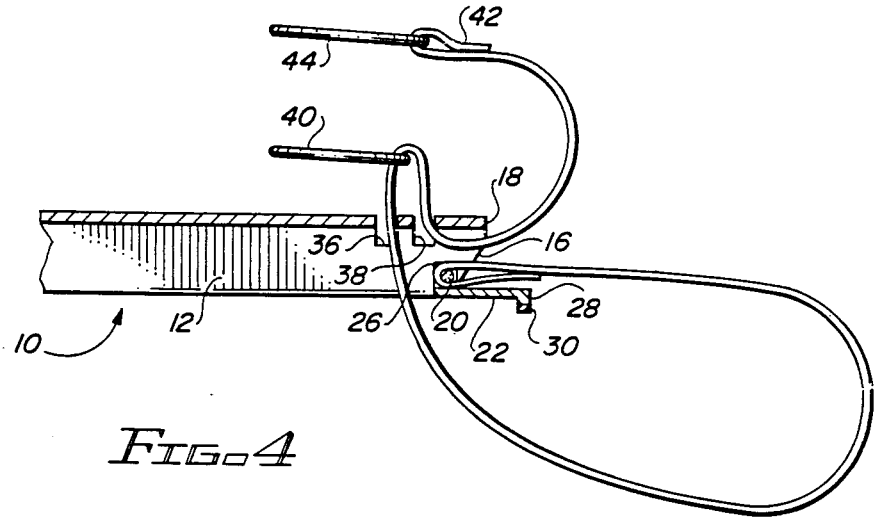
FIG. 4

MULTI-PURPOSE STRAP-TYPE WRENCH

BACKGROUND OF THE INVENTION

Field of the Invention

The present invention relates generally to a strap-type wrench for removing rotatable closures, and more particularly to an improved strap-type wrench having two rings to assist in removing the slack in the gripping strap, and a pressure plate with a frictional gripping surface positioned on the wrench to allow the frictional gripping surface to be forced radially inwardly against the object being gripped by the wrench, thereby enhancing the frictional grip of the frictional gripping surface on the object.

Strap-type wrenches of widely varying designs have proliferated over the years, with the wrenches being for the most part separated into two different design categories. These categories are, first, wrenches having flat metal bands as the gripping surface, and secondly, wrenches having flat fabric straps as the gripping surface. The first of these categories primarily includes wrenches used for oil filters, with typical examples being U.S. Pat. No. 3,686,984, to Kelso, U.S. Pat. No. 3,838,615, to McFarland et al., U.S. Pat. No. 3,728,916, to Brantley, U.S. Pat. No. 4,158,974, to Yamashita, and U.S. Patent No. 4,598,615, to Tate. These devices differ mainly in the camming mechanism used to tighten the metal band. Also in this category is U.S. Pat. No. 3,964,115, to Platek, which is a device for removing jar tops.

The wrenches in this first category all suffer from several disadvantages. First, since a relatively rigid metal band is used, these devices are not practically adjustable, since the metal bands used in the devices are not of adjustable length. The implication of this fact is that the wrenches in this category are useful only on articles within a relatively small size variation. The implication of this point is enhanced through an understanding that the size of oil filters varies substantially, therefore requiring several different wrenches to enable the removal or installation of all of the various filters.

Another disadvantage of this first category of wrench is that the metal bands tend to slip somewhat when used on smooth round surfaces. This is particularly a problem in the removal of oil filters, which are likely to have oil on the outer surface thereof. Still another disadvantage of the first category of wrench is that they are necessarily of larger size than wrenches in the second category. This is readily apparent since the metal bands do not collapse for storage. It will be realized by those skilled in the art that compact size is a distinct advantage, since most owners of such wrenches will have a number of tools and a limited amount of storage space for the tools.

The second category, wrenches having flat fabric straps as the gripping surface, is illustrated by U.S. Pat. No. 689,325, to Sands, U.S. Pat. No. 840,496, to Justen, U.S. Pat. No. 3,678,788, to Matti, U.S. Pat. No. 4,345,494, to Aamodt, and U.S. Pat. No. 4,532,833, to Downs. These wrenches offer the advantages of being useable on widely varying sizes of articles and of being compact of size, both of which advantages are due to the use of a fabric strap rather than a metal band. However, the known designs of such devices are not without disadvantage.

For example, in some of these wrenches there is no positive retention of the free end of the strap, thereby allowing the strap to expand in size due to slippage, as illustrated by the Justen device. Several of the above devices get around this by having positive adjustment stops for the free end of the strap, as taught by the Sands reference. This makes the wrench more difficult to use, since the appropriate adjustment must generally be found by trial and error. It also undesirably results in a wrench having several discrete sizes rather than being infinitely adjustable.

However, the biggest single disadvantage of the second category of wrench is that it also has a tendency to slip on smooth round surfaces, like the wrenches in the first category. It is readily apparent that a woven nylon strap, which is the most commonly used flexible fabric strap, does not have a high coefficient of friction which will enable the wrench to strongly grip the surface of smooth round articles, such as oil filters. In the final analysis, grip strength is the most important single element of a strap-type wrench, and the wrenches in the second category have a distinct disadvantage, with even the far from ideal wrenches of the first category out performing them on this count.

It is accordingly the primary objective of the present invention to provide a strap-type wrench which will be highly resistant to slippage on the article being gripped, even if that article is a smooth round surface. Such an improved wrench must of course remain useable on all types and configurations of surfaces, not being limited to use on cylindrical surfaces only. It is also an objective of the present invention that it utilize a fabric strap, thereby being of inherently smaller size than wrenches in the first category.

It is an additional objective of the present invention that the wrench be infinitely and easily adjustable. It is desirable that this be accomplished without requiring discrete positive adjustment stops for the free end of the strap, the elimination of which makes the wrench easier to use. It is desirable that the wrench be infinitely adjustable rather than having several discrete sizes, thereby allowing the appropriate adjustment to be made quickly and easily rather than being found by trial and error.

It is an additional objective of the present invention to allow for quick and easy adjustment of the strap around the object being gripped. Finally, it is also an objective of the present invention to provide a positive retention of the free end of the strap to prevent the strap from expanding in size due to slippage. This positive retention should be a function of the design of the wrench rather than being an additional control, or requiring a positive step to be performed to secure the strap against expansion. The wrench of the present invention should also be of inexpensive construction, thereby giving it an economic advantage as well. Finally, the improved wrench of the present invention should provide all of the aforesaid advantages and objectives without incurring any relative disadvantage.

SUMMARY OF THE INVENTION

The disadvantages and limitations of the background art discussed above are overcome by the present invention. With this invention, an inverted U-shaped segment of channel is used as a handle for the wrench. Apertures are located in the ends of the legs of the U at the first end of the handle, with a pin extending through the apertures being used to rotatably support a pressure plate at one end thereof. One end of a flexible, flat strap is also secured to the pin, with the strap extending from the first end of the handle between the bottom of the U and the pressure plate.

Two parallel slots are located in the bottom of the U in the first end of the handle. The strap is looped around the pressure plate and into the U of the handle and through the slot furthest from the first end of the handle. The strap is then inserted through a first slack adjusting ring, and then through the other slot in the handle. The strap then exits the U of the handle from the first end of the handle, between the bottom of the U and the end of the strap attached to the pin. A second slack adjusting ring is then attached to the other end of the strap.

An article to be gripped is placed in the loop formed by the strap between the one end of the strap and the slot furthest from the first end of the handle. The free end of the pressure plate is located between the strap near the free end thereof and the article to be gripped. The free end of the pressure plate in the preferred embodiment has a frictional gripping surface facing the article to be gripped. The first slack adjusting ring is pulled to tighten the strap around the object to be gripped, and the second slack adjusting ring is then pulled to take up the slack created by pulling the first slack adjusting ring.

The other end of the wrench is then rotated with respect to the pressure plate to consecutively trap: a. the portion of the strap between the other slot and the other end of the strap, and b. the one end of the strap, between the first end of the wrench and the pressure plate. The first end of the wrench handle is thus bearing against the end of the pressure plate on which the frictional gripping surface is located with an essentially radially inwardly directed force. This frictionally acts to retain the strap in the desired position, thus preventing slipping of the strap. In addition, the frictional gripping surface on the pressure plate will be urged radially inwardly into the surface of the article being gripped, thus preventing slippage of wrench on the article being gripped.

Thus, the improved strap-type wrench of the present invention is highly resistant to slippage on the article being gripped, even if that article is a smooth round surface. The pressure plate with the frictional gripping surface provides a significant advantage in obtaining a firm grip not found in other strap wrenches. The wrench of the present invention remains useable on all types and configurations of surfaces, and accordingly is not limited to use on cylindrical surfaces only. Since the wrench of the present invention utilizes a fabric strap, it is of inherently smaller size than metal band strap wrenches, and thus is more compact and easier to store than such wrenches.

The wrench of the present invention is also advantageously both infinitely and easily adjustable. This significant advantage is accomplished without requiring discrete positive adjustment stops for the free end of the strap, making the wrench of the present invention easier to use than wrenches having such discrete adjustment stops. Since the improved wrench of the present invention is infinitely adjustable rather than having several discrete sizes, the appropriate adjustment may be made quickly and easily rather than being found by trial and error.

The wrench of the present invention also allows for quick and easy adjustment of the strap around the object being gripped through the use of the two slack adjusting rings. Finally, the present invention provides a positive frictional retention of the free end of the strap to prevent the strap from expanding in size due to slippage. This positive retention is a function of the design of the wrench and as such does not require an additional control or requiring the performance of a positive step to secure the strap against expansion. The wrench of the present invention is also of inexpensive construction, thereby giving it an economic advantage as well. Finally, the improved wrench of the present invention provides all of the aforesaid advantages and objectives without incurring any relative disadvantage.

DESCRIPTION OF THE DRAWINGS

These and other advantages of the present invention are best understood with reference to the drawings, in which:

FIG. 1 is a perspective view of the strap wrench of the present invention;

FIG. 2 is a side view of the pressure plate used in the wrench shown in FIG. 1 having the frictional gripping surface located at one end thereof;

FIG. 3 is an end view of the pressure plate shown in FIG. 2 from the end which is rotatably mounted on the pin;

FIG. 4 is a side cutaway view of the strap wrench shown in FIG. 1, showing the configuration and location of the strap on the wrench;

DETAILED DESCRIPTION OF THE PREFERRED EMBODIMENT

Figure 5:
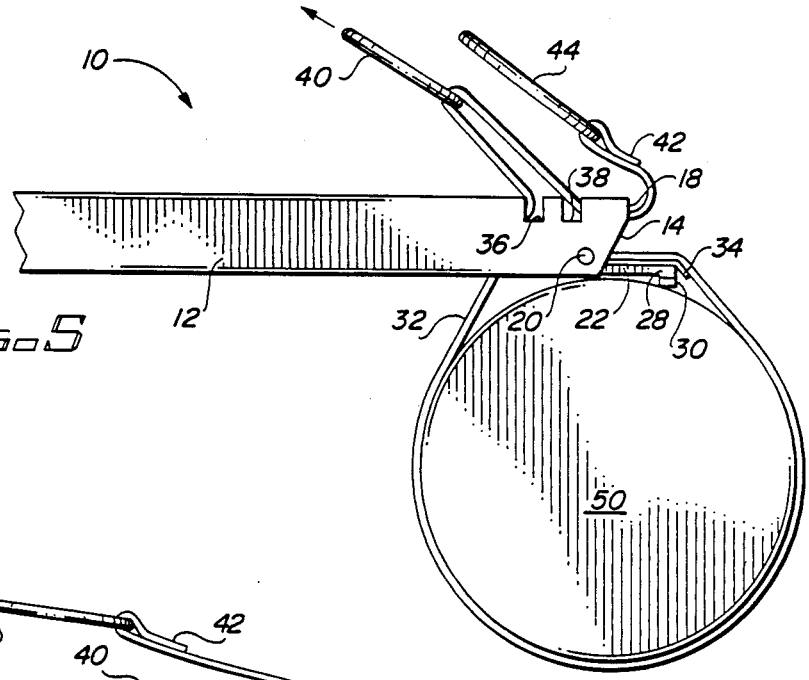
FIG. 5 is a side view of the strap wrench of Figure gripping a cylindrical object, with the first slack adjusting ring being pulled to take up slack in the portion of the strap around the cylindrical object.

The preferred embodiment of the present invention is illustrated in FIGS. 1 through 4, which show a strap wrench 10. The strap wrench 10 is based on a handle 12, which in the preferred embodiment is made of an inverted segment of U-shaped channel. The handle 12 has the gripping portion mounted at one end thereof, which end shall be described generally herein as the first end. The other end of the handle 12 is used to grip the strap wrench 10, and shall be described generally herein as the second end. The handle 12 is described as an inverted U since in the figures and specification the top of the handle 12 is the bottom of the U, and the bottom of the handle 12 is formed by the unattached ends of the legs of the U.

The legs of the U on the first end of the handle 12 are angled, as best shown in FIG. 4, with the bottom of the U extending outward further than the unattached ends of the legs. The angled portions on the first end of the handle 12 are referred to with the reference numerals 14 and 16. In the preferred embodiment, the angle of the angled portions 14 and 16 is approximately thirty degrees. The bottom of the U (on the top of the handle 12) is flat rather than angled, as shown in FIG. 4, and is referred to with the reference numeral 18. In the preferred embodiment, the handle is made of aluminum.

Located at the first end of the handle 12 near the unattached ends of the legs of the U are a pair of apertures, with one of the apertures being in each leg of the U. A pin 20 extends through the apertures between the legs of the U, with the ends of the pin 20 being fixed in the apertures. Rotatably mounted on the pin 20 is a pressure plate 22, which is best shown in FIGS. 2 and 3. The pressure plate 22 is essentially flat with a pair of upwardly extending legs 24 and 26 located on opposite sides of one end thereof, with the legs 24 and 26 having apertures therein through which the pin 20 extends, as shown in FIGS. 1 and 4.

Referring again to FIGS. 2 and 3, the other end of the pressure plate 22 extends slightly downwardly (in the opposite direction from the upwardly extending legs 24 and 26) a shown at 28. Located on the downwardly extending portion 28 is a frictional gripping surface 30. This frictional gripping surface 30 is in the preferred embodiment made of rubber to provide superior gripping strength. It is only necessary that the frictional gripping surface 30 provide a good grip on the surface of an article the strap wrench 10 is to be used on. An alternate to rubber for the frictional gripping surface 30 is the use of a series of sharp metal surfaces, such as diamond-shaped serrations having sharp metal edges.

Referring to FIGS. 1 and 4, it should be noted that the end of the pressure plate 22 having the downwardly extending portion 28 thereon, when rotated counterclockwise, will move toward the flat portion 18 of the first end of the handle 12 at the base of the U. In addition to the pressure plate 22, one end of a flat fabric strap 32 is also attached to the pin 20. The strap 32 is preferably made of woven nylon material, or another material having excellent strength, durability, and flexibility. The strap 32 has two ends, and the one of these ends which is attached to the pin 20 shall generally be referred to herein as the first end 34. The first end 34 of the strap 32 is attached to the pin 20 by looping the first end 34 around the pin 20, and stitching or otherwise fixedly attaching the first end 34 of the strap 32 to the portion of the strap 32 adjacent the first end 34 of the strap 32.

In the preferred embodiment, the side of the loop containing the first end 34 of the strap 32 faces the pressure plate 22, as best shown in FIG. 4. The strap 32 extends from the loop around the pin 20 through the first end of the handle 12 between the angled portions 14 and 16, and is also between the bottom of the U and the pressure plate 22 as shown in FIG. 4.

Referring to FIGS. 1 and 4, located on the top of the handle 12 are two parallel slots 36 and 38 cut through the bottom of the U and (optionally) partially into the legs of the U. The slots 36 and 38 are orthogonal to the axis of the handle 12, and are located near the first end of the handle 12. The slot located further from the first end of the handle 12 is the first slot 36, and the slot located closer to the first end of the handle 12 is the second slot 38.

Referring now to FIG. 4, the free end of the strap 32 is looped around the pressure plate 22 and up from the bottom of the handle 12 between the legs of the U through the first slot 36. The free end of the strap 32 is then inserted through a first slack adjusting ring 40, and then from the top of the handle 12 through the second slot 38 in the handle 12 into the portion between the legs of the U. The free end of the strap 32 then exits the underside of the handle 12 from the first end of the handle 12 between the bottom of the U and the loop in the first end 34 of the strap 32 attached to the pin 20.

The end of the strap 32 referred to above as the free end of the strap 32 is a second end 42 of the strap 32, and it is brought over the top of the handle 12 toward the second end of the handle 12 as shown in FIG. 1. The second end 42 of the strap 32 is attached to a second slack adjusting ring 44 by looping the second end 42 around the second slack adjusting ring 44, and stitching or otherwise fixedly attaching the second end 42 of the strap 32 to the portion of the strap 32 adjacent the second end 42 of the strap 32.

The above description completes the assembly and description of the strap wrench 10 of the preferred embodiment. An additional embellishment illustrated in FIG. 1 is a bottle opener 46, which is mounted on the second end of the handle 12. It is apparent that the bottle opener 46 does not add to the functionality of the strap wrench 10 as a wrench, but rather represents a convenient addition to the device. Another modification which is contemplated is to coat all but the first end of the handle 12 with rubber or the like to provide an excellent grip.

The operation of the strap wrench 10 may be discussed in conjunction with a cylindrical object 50, shown in FIG. 5. The cylindrical object 50 is placed in the loop formed by the portion of the strap 32 between the first end 34 of the strap 32 and the first slot 36 in the handle 12. The free end of the pressure plate 22 (the end opposite the upwardly extending legs 24 and 26 shown in FIG. 2) is located between the strap 32 (near the first end 34 thereof) and the cylindrical object 50. The frictional gripping surface 30 of the pressure plate 22 faces the surface of the cylindrical object 50.

Figure 6:
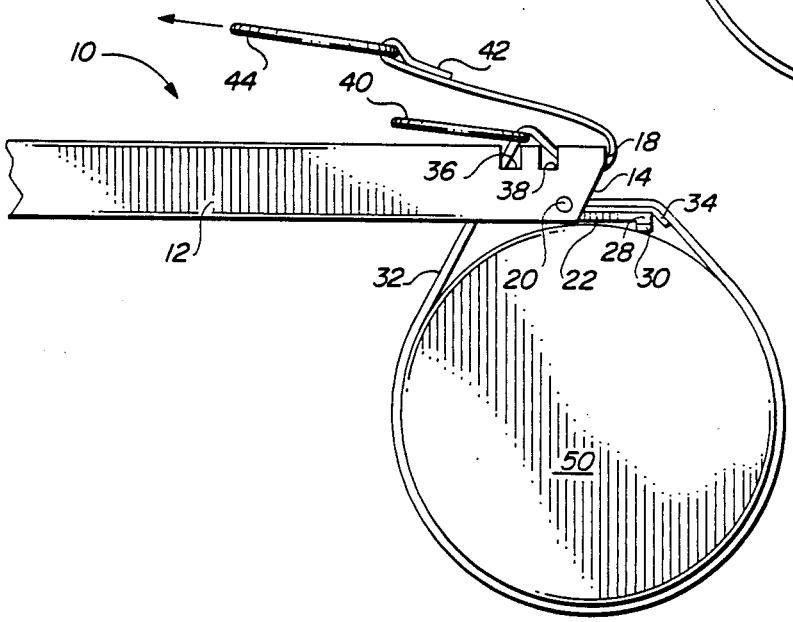
FIG. 6 is a side view of the strap wrench of Figure gripping the cylindrical object of FIG. 5, with the second slack adjusting ring being pulled to take up slack generated by pulling the first slack adjusting ring.

The first slack adjusting ring 40 is pulled to tighten the strap 32 around the cylindrical object 50 as shown in FIG. 5. Note that the first slack adjusting ring 40 may be pulled in the direction shown, or in a direction straight up from the first slot 36. Following this step, the second slack adjusting ring 44 is pulled to take up the slack created by pulling the first slack adjusting ring 40, as shown in FIG. 6. During this step, the first slack adjusting ring 40 is pulled by the strap 32 to a location between the first and second slots 36 and 38 as shown. Note that the second slack adjusting ring 44 may be pulled in the direction shown, in a direction straight up from the flat portion 18 of the first end of the handle 12, or from the first end of the handle 12.

Figure 7:
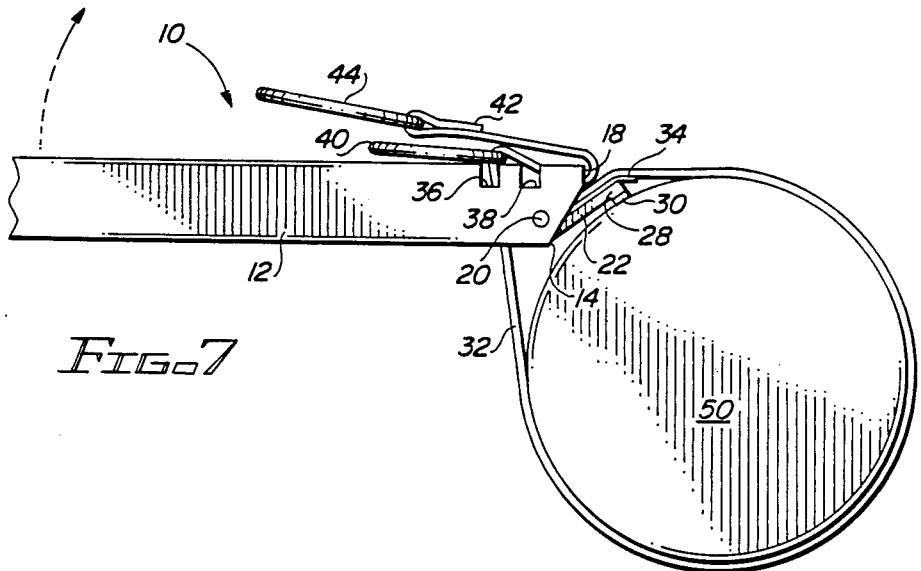
FIG. 7 is a side view of the strap wrench of FIG. 1 gripping the cylindrical object of FIGS. 5 and 6, with the wrench rotated to grip the strap firmly between the end of the wrench and the pressure plate, and to urge the frictional gripping surface on the pressure plate radially inwardly against the cylindrical object.

Referring now to FIG. 7, the other end of the handle 12 is then rotated with respect to the pressure plate 22 and the cylindrical object 50 to consecutively trap: a. the portion of the strap 32 between the second slot 38 and the second end 4 of the strap 32, and b. the loop including the first end 34 of the strap 32, between the flat portion 18 of the first end of the handle 12 and the top of the pressure plate 22. The flat portion 18 of the first end of the handle 12 is bearing through the portions of the strap 32 against the top of the free end of the pressure plate 22 with an essentially radially inwardly directed force (relative to the cylindrical object 50).

This frictionally acts to retain the strap 32 in the desired position, thus preventing slipping of the strap 32 causing a release of the cylindrical object 50. In addition, the frictional gripping surface 30 on the pressure plate 22 will be urged radially inwardly into the surface of the cylindrical object 50, thus preventing slippage of the strap wrench 10 on the cylindrical object 50. It will be appreciated by those skilled in the art that the strap wrench 10 may be used either to loosen or to tighten the cylindrical object 50, or any other object which will fit in the highly adjustable strap 32.

It is thus apparent from the above description of the preferred embodiment of the improved strap-type wrench of the present invention that it is highly resistant to slippage on the article being gripped, even if that article is a cylinder having a smooth round surface. The pressure plate and the frictional gripping surface thereon provide a significant advantage in obtaining a firm grip not found in other strap wrenches. The wrench of the present invention is useable on different types and configurations of surfaces, and as such is not limited to use on cylindrical surfaces only. Since the strap used in the wrench of the present invention is fabric, the wrench is of inherently smaller size than metal band strap wrenches, and thus is more compact and easier to store than such wrenches.

The wrench of the present invention is also infinitely adjustable, with the adjustment process being accomplished with ease. This is accomplished without requiring discrete adjustment stops for the free end of the strap, thereby making the wrench of the present invention easier to use than wrenches having such discrete adjustment stops. Since the wrench of the present invention is infinitely adjustable rather than having several discrete sizes, an adjustment of the wrench may be made quickly and easily.

The wrench of the present invention thus allows for quick and easy adjustment of the strap around the object being gripped through the use of the slack adjusting rings. Finally, the wrench of the present invention provides a positive frictional retention of the free end of the strap, preventing the strap from expanding in size due to slippage. This positive retention is a function of the design of the wrench, and does not require an additional control or the performance of a positive step to secure the strap against expansion. The wrench of the present invention is of inexpensive construction, making it an economically desirable tool. Finally, the improved wrench of the present invention provides all of the aforesaid advantages and objectives without incurring any relative disadvantage.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A strap wrench for grasping and rotating articles, comprising:

a handle made of material having an inverted U-shaped cross section with an upper portion and depending legs, said handle having a first end and a second end, said handle having first and second parallel slots extending through a section of the upper portion and partially into the depending legs near said first end of said handle, said second slot being closer to said first end of said handle than said first slot is to said first end of said handle;

a pressure plate rotatably mounted at one end thereof at said first end of said handle;

a flexible strap having a first end and a second end, said first end of said flexible strap being attached to the first end of said handle, said flexible strap extending from said first end of said handle over and around said pressure plate, up through said first slot, down through said second slot, and out said first end of said handle above said first end of said flexible strap;

a first slack adjusting ring having the portion of said flexible strap extending between said first and second slots extending therethrough; and a second slack adjusting ring attached to said second end of said flexible strap, the portion of said flexible strap between said first end of said flexible strap and said first slot being place around an article to be grasped, said first and second slack adjusting rings being sequentially pulled to remove slack from said portion of flexible strap, said first end of said handle being moved to pinch the portion of said flexible strap adjacent said first end of said flexible strap and the portion of said flexible strap extending out said first end of said handle between said first end of said handle and said pressure plate.

2. A strap wrench as defined in claim 1, wherein the depending legs on said first end of said handle are angled, with the upper portion extending outward further than the unattached ends of the legs.

3. A strap wrench as defined in claim 2, wherein the angle of the angled portions of the depending legs is approximately thirty degrees.

4. A strap wrench as defined in claim 2, wherein the first end of said handle at the upper portion is flat rather than angled like the depending legs.

5. A strap wrench as defined in claim 1, wherein said handle is made of aluminum.

6. A strap wrench as defined in claim 1, additionally comprising:

a pin extending through a pair of apertures located at said first end of said handle near the unattached ends of the depending legs with one of the apertures being in each depending, with the ends of said pin being fixed in the apertures.

7. A strap wrench as defined in claim 6, wherein said pressure plate is rotatably mounted on said pin.

8. A strap wrench as defined in claim 7, wherein said first end of said flexible strap is attached to said pin.

9. A strap wrench as defined in claim 8, wherein said first end of said flexible strap is attached to said pin by looping said first end around said pin, and fixedly attaching said first end of said flexible strap to the portion of said flexible strap adjacent said first end of said flexible strap

10. A strap wrench as defined in claim 6, wherein said pressure plate is essentially flat with a pair of upwardly extending legs located on opposite sides of one end thereof, said legs having apertures therein through which said pin extends.

11. A strap wrench as defined in claim 1, additionally comprising:

a frictional gripping surface on the other end of said pressure plate, said frictional gripping surface thereby facing toward an article to be grasped.

12. A strap wrench as defined in claim 11, wherein said frictional gripping surface is made of rubber to provide superior gripping strength.

13. A strap wrench as defined in claim 11, wherein said frictional gripping surface comprises:

a series of diamond-shaped serrations having sharp metal edges.

14. A strap wrench as defined in claim 1, wherein said flexible strap is made of a woven material.

15. A strap wrench as defined in claim 14, wherein said flexible strap is made of woven nylon material.

16. A strap wrench as defined in claim 1, wherein said first slack adjusting ring is pulled to tighten said flexible strap around an article to be grasped, and said second slack adjusting ring is then pulled to take up the slack created by pulling said first slack adjusting ring, causing said first slack adjusting ring to be pulled by said flexible strap to a location between said first and second slots.

17. A strap wrench as defined in claim 1, wherein said handle and said pressure plate are so arranged and configured so that said first end of said handle bears through said flexible strap against the top of the free end of said pressure plate with an force directed essentially radially inwardly relative to the article to be grasped.

18. A strap wrench as defined in claim 1, wherein said second end of said flexible strap is attached to said second slack adjusting ring by looping said second end around said second slack adjusting ring, and fixedly attaching said second end of said flexible strap to the portion of said flexible strap adjacent said second end of said flexible strap.

19. A strap wrench for grasping and rotating articles, comprising:

a handle made of material having an inverted U-shaped cross section with an upper portion and depending legs, said handle having a first end and a second end, said handle having first and second parallel slots extending through a section of the upper portion and partially into the depending legs near said first end of said handle, said second slot being closer to said first end of said handle than said first slot is to said first end of said handle;

a pin extending through a pair of apertures located at said first end of said handle near the unattached ends of the depending legs, with one of the apertures being in each depending leg, with the ends of the pin being fixed in the apertures;

a pressure plate rotatably mounted at one end thereof on said pin;

a frictional gripping surface on the other end of said pressure plate, said frictional gripping surface facing toward an article to be grasped;

a flexible strap having a first end and a second end, said first end of said flexible strap being attached to said pin and extending from said first end of said handle over and around said pressure plate, up through said first slot, down through said second slot, and out said first end of said handle above said first end of said flexible strap;

a first slack adjusting ring having the portion of said flexible strap extending between said first and second slots extending therethrough; and a second slack adjusting ring attached to said second end of said flexible strap, the portion of said flexible strap between said first end of said flexible strap and said first slot being placed around an article to be grasped, said first and second slack adjusting rings being sequentially pulled to remove slack from said portion of flexible strap, said first end of said handle being moved to pinch the portion of said flexible strap adjacent said first end of said flexible strap and the portion of said flexible strap extending out said first end of said handle between said first end of said handle and said pressure plate.

20. A strap wrench for grasping and rotating articles, comprising:

a handle made of material having an inverted U-shaped cross section with an upper portion and depending legs, said handle having a first end and a second end, said handle having first and second parallel slots extending through a section of the upper portion and partially into the depending legs near said first end of said handle, said second slot being closer to said first end of said handle than said first slot is to said first end of said handle;

a pressure plate rotatably mounted at one end thereof at said first end of said handle;

a flexible strap having a first end and a second end, said first end of said flexible strap being attached to the first end of said handle, said flexible strap extending from said first end of said handle over and around said pressure plate, up through said first slot, down through said second slot, and out said first end of said handle above said first end of said flexible strap; and means for removing the slack from the portion of said flexible strap between said first end of said flexible strap and said first slot when said portion of said flexible strap is placed around an article to be grasped.

21. A strap wrench as defined in claim 20, wherein said removing means comprises:

a first slack adjusting ring having the portion of said flexible strap extending between said first and second slots extending therethrough; and a second slack adjusting ring attached to said second end of said flexible strap.

22. A method for grasping and rotating articles with a strap-type wrench having (a) first and second parallel slots in a handle made of material having an inverted U-shaped cross section with an upper portion and depending legs, said handle having a first end and a second end, said first and second parallel slots extending through a section of the and partially into the depending legs near said first end of said handle, said second slot being closer to said first end of said handle than said first slot is to said first end of said handle;

(b) a pressure plate rotatably mounted to one end thereof at said first end of said handle;

(c) a first end of a flexible strap attached to the first end of said handle, said strap extending from said first end of said handle over and around said pressure plate, up through said first slot, down through said second slot, and out said first end of said handle above said first end of said flexible strap, said flexible strap also having a second end;

(d) a first slack adjusting ring extending around a portion of said flexible strap extending between said first and second slots;

(e) a second slack adjusting ring attached to said second end of said flexible strap, said method comprising:

(1) placing the portion of said flexible strap between said first end and said first slot around an article to be grasped;

(2) sequentially pulling said first and second slack adjusting rings to remove slack from said portion of flexible straps; and (3) moving said first end of said handle to pinch the portion of said flexible strap adjacent said first end of said flexible strap and the portion of said flexible strap extending out said first end of said handle between said first end of said handle and said pressure plate.

* * * * *